US010968549B1

(12) United States Patent
Li et al.

(10) Patent No.: US 10,968,549 B1
(45) Date of Patent: Apr. 6, 2021

(54) FABRIC WITH HIGH SHIELDING PERFORMANCE, PREPARATION METHOD THEREOF, AND APPLICATION THEREOF IN PREPARING ADVERTISING FABRIC

(71) Applicant: Zhejiang Dejun New Material Co., Ltd., Jiaxing (CN)

(72) Inventors: Qiang Li, Jiaxing (CN); Guijun Wang, Jiaxing (CN)

(73) Assignee: ZHEJIANG DEJUN NEW MATERIAL CO., LTD., Jiaxing (CN)

( * ) Notice: Subject to any disclaimer, the term of this patent is extended or adjusted under 35 U.S.C. 154(b) by 0 days.

(21) Appl. No.: 16/853,784

(22) Filed: Apr. 21, 2020

(30) Foreign Application Priority Data

Jan. 21, 2020 (CN) ..... 202010072589.1
Mar. 30, 2020 (CN) ..... 202010236647.X
Apr. 14, 2020 (CN) ..... 202010292290.7

(51) Int. Cl.
*D04B 21/08* (2006.01)
*D04B 27/24* (2006.01)

(52) U.S. Cl.
CPC ..... *D04B 21/08* (2013.01); *D04B 27/24* (2013.01); *D10B 2331/04* (2013.01); *D10B 2401/14* (2013.01); *D10B 2401/20* (2013.01); *D10B 2505/00* (2013.01)

(58) Field of Classification Search
CPC ..... D04B 27/24; D04B 21/08; D04B 21/06; D04B 21/16; D04B 23/16
See application file for complete search history.

(56) References Cited

U.S. PATENT DOCUMENTS 2,734,001 A * 2/1956 Mecklenburgh et al. ..... D06M 11/155 442/103
3,922,888 A * 12/1975 Patterson ..... D04B 21/06 66/192
4,067,209 A * 1/1978 Kucera ..... D04B 21/14 66/193
4,567,075 A * 1/1986 Krawczyk ..... D04B 21/02 428/91

(Continued)

FOREIGN PATENT DOCUMENTS

CN 101724973 A 6/2010
CN 102555936 A 7/2012

(Continued)

*Primary Examiner* — Danny Worrell
(74) *Attorney, Agent, or Firm* — Bayramoglu Law Offices LLC

(57) ABSTRACT

A fabric with high shielding performance and a preparation method thereof are provided. The method includes: (1) selecting a polyester textured yarn with a denier ranging from 15 D to 50 D and a polyester filament yarn with a denier ranging from 15 D to 50 D as the yarns; (2) using three guide bars for knitting in a warp knitting machine; yarn lapping movement the first guide bar and the second guide bar use the polyester textured yarn, the first guide bar and the second guide bar knit with a modified warp plain fabric structure, the third guide bar uses the polyester filament yarns, and the third guide bar knits with a chain-stitch fabric structure; (3) jet dyeing performing a direct dyeing treatment on greige by a jet dyeing machine; and (4) carrying out a Stenter setting on a setting machine.

11 Claims, 5 Drawing Sheets

(56) References Cited

U.S. PATENT DOCUMENTS

| | | | | | |
|---|---|---|---|---|---|
| 4,638,648 | A * | 1/1987 | Gajjar | D04B 21/18 | 66/193 |
| 4,688,403 | A * | 8/1987 | Gajjar | D04B 21/18 | 66/195 |
| 4,712,281 | A * | 12/1987 | Scheller | D04B 21/02 | 28/162 |
| 4,785,613 | A * | 11/1988 | Rhode | D04B 21/20 | 56/202 |
| 5,029,457 | A * | 7/1991 | Gajjar | D04B 21/06 | 66/195 |
| 5,461,884 | A * | 10/1995 | McCartney | A43B 1/04 | 66/170 |
| 5,596,888 | A * | 1/1997 | McLarty, III | D04B 21/18 | 66/192 |
| 5,638,703 | A * | 6/1997 | Callaway | D04B 21/20 | 56/202 |
| 5,791,164 | A * | 8/1998 | Carroll | D04B 21/04 | 66/194 |
| 6,253,581 | B1 * | 7/2001 | Rhode | D04B 21/00 | 66/170 |
| 6,688,143 | B2 * | 2/2004 | Williams | D04B 21/16 | 442/310 |
| 6,770,581 | B1 | 8/2004 | DeMott et al. | | |
| 6,845,639 | B1 * | 1/2005 | Hajek | A44B 18/0034 | 66/195 |
| 7,415,845 | B1 * | 8/2008 | Graichen | D04B 21/06 | 66/170 |
| 2007/0055093 | A1 | 3/2007 | Beraud | | |
| 2011/0247370 | A1 * | 10/2011 | Akao | D04B 21/16 | 66/195 |
| 2013/0298612 | A1 * | 11/2013 | Yuikawa | D04B 23/16 | 66/195 |

FOREIGN PATENT DOCUMENTS

| | | | |
|---|---|---|---|
| CN | 102660837 | A | 9/2012 |
| CN | 202744764 | U | 2/2013 |
| CN | 206189000 | U | 5/2017 |
| CN | 108842281 | A | 11/2018 |
| CN | 208646182 | U | 3/2019 |
| DE | 2615002 | A1 | 10/1977 |
| DE | 202011001211 | U1 | 3/2011 |
| DE | 102011016885 | B3 | 10/2012 |
| DE | 102014012964 | B3 | 10/2015 |
| EP | 1024215 | A1 | 8/2000 |
| JP | S6019001 | A | 1/1985 |
| JP | 2005281932 | A | 10/2005 |

* cited by examiner

FABRIC WITH HIGH SHIELDING PERFORMANCE, PREPARATION METHOD THEREOF, AND APPLICATION THEREOF IN PREPARING ADVERTISING FABRIC

CROSS REFERENCE TO THE RELATED APPLICATIONS

This application is based upon and claims priority to Chinese Patent Application No. 202010072589.1, filed on Jan. 21, 2020, Chinese Patent Application No. 202010236647.X, filed on Mar. 30, 2020, and Chinese Patent Application No. 202010292290.7, filed on Apr. 14, 2020, the entire contents of which are incorporated herein by reference.

TECHNICAL FIELD

The present invention relates to a method for preparing a fabric and a product thereof, and more specifically, relates to a fabric with high shielding performance, a preparation method thereof, and an application thereof in preparing advertising fabric.

BACKGROUND

Fabrics used as advertising fabrics generally must be treated with a coating on the surface to enhance their shielding performance and uniform photopermeability. The coating substances and methods are not especially environmentally friendly and many cause pollution. Fabrics without the coating treatment, however, exhibit less than desirable qualities. Spotty light leakage problems occur, for example, when background lighting is used for making the ad more visible. Therefore, to avoid this problem, a fabric with high shielding performance is needed.

The visual shielding performance of a fabric depends on ambient light sources and the light absorption and reflection characteristics of the fabric. The internal structure of the fabric knit in large part determines its light absorption and reflection. Until the subject invention, there have been no methods suitable for producing a fabric with high shielding performance.

SUMMARY

One object of the present invention is to provide a method for preparing a fabric with high shielding performance to solve the problems described in the background.

Another object of the present invention is to provide a fabric with high shielding performance to solve the technical drawbacks in the prior art that advertising fabrics need to be treated with a coating and therefore are not environmentally friendly, and the existing fabrics as advertising fabrics have insufficient shielding performance.

The present invention uses the following technical solutions to solve the above technical problems.

A method for preparing a fabric with high shielding performance includes the following steps:

(1) yarn selection: selecting a polyester textured yarn with a denier ranging from 15 Denier (D) to 50 D and a polyester filament yarn with a denier ranging from 15 D to 50 D as yarns;

(2) warp-knitting: knitting in a warp knitting machine using three guide bars, wherein the three guide bars are fully threaded and have a same yarn lapping movement direction, the first guide bar and the second guide bar use the polyester textured yarn for knitting in a modified warp plain fabric structure, and the third guide bar uses the polyester filament yarn for knitting in a chain-stitch fabric structure;

(3) jet dyeing: performing a direct dyeing treatment on greige by a jet dyeing machine; and (4) post-finishing: carrying out a Stenter setting on a Stenter setting machine.

The denier of the yarns is limited in the range of 15 D-50 D mainly due to the following reasons:

1. Fabric weight (gsm): under the same conditions of other processes, the thicker the yarn, the thicker the fabric, and the higher the fabric weight, which will increase the cost and the product price. The biggest drawback here is that the stiffness of the fabric will increase and the anti-wrinkle performance of the fabric will decrease, which is extremely detrimental to the end-use of the product.

2. The thicker the yarn, the larger the amount of warp required in the manufacture of the yarn, the larger the loop formed by the yarn in the fabric. The larger the loop, the larger the pores in the loop, which decreases the shielding performance of the fabric.

3. If the yarn is too thin, the fabric will be too thin, which causes insufficient shielding performance.

4. The denier of the yarn is set within 15 D-50 D, mainly to control the fabric weight to 200-300 gsm, taking into account both the economic performance of the fabric and the various properties required by advertising fabrics.

Preferably, the denier of the yarn ranges from 20 D to 50 D.

Preferably, for the yarn selection, the first guide bar and the second guide bar use a polyester textured yarn with a denier of 15 D-50 D/6 F-144 F as the yarn. The third guide bar uses a polyester filament yarn with a denier of 15 D-50 D/1 F-144 F as the yarn.

Further preferably, for the yarn selection, the first guide bar and the second guide bar use a polyester textured yarn with a denier of 20 D-50 D/12 F-144 F as the yarn. The third guide bar uses a polyester filament yarn with a denier of 20 D-50 D/1 F-144 F as the yarn. Most preferably, a polyester textured yarn with a denier of 30 D/36 F and a polyester filament yarn with a denier of 30 D/72 F are selected as the yarns.

The significance of limiting the number of yarn filaments in the yarn selection is as follows:

1. The number of yarn filaments (unit: F) has a great influence on the shielding performance of the fabric. Under the same denier, the greater the number of yarn filaments, the better the dispersion and spread of yarn filaments in the yarn on the fabric surface, the better the flatness of the fabric surface, and the higher the smooth finish of the fabric surface. The key point is that the yarn filaments can effectively help cover the gap between the extension yarns of the fabric. Combined with the favorable longitudinal loop density, the fabric with the excellent shielding performance can be obtained.

2. However, the larger the number of yarn filaments, the lower the knitting performance of the yarn on warp knitting, because the yarn filaments are prone to diverge. It is easy to produce broken filaments during warping, and the broken filaments from the warping will increase the probability of yarn breakage during knitting. Moreover, if the yarn filaments are prone to diverge during knitting, some yarn filaments cannot be fed into the needle hook and therefore yarn breakage occurs.

3. The more the yarn filaments, the higher the price of the yarn.

Preferably, in the structure of the fabric, the notation of the first guide bar is 1-0/4-5//, the notation of the second guide bar is 1-0/4-5//, and the notation of the third guide bar is 1-0/0-1//.

Preferably, in the structure of the fabric, the notation of the first guide bar is 1-0/4-5//, the notation of the second guide bar is 1-0/4-5//, and the notation of the third guide bar is 1-0/1-0//.

Preferably, in the structure of the fabric, the notation of the first guide bar is 1-0/4-5//, the notation of the second guide bar is 1-0/3-4//, and the notation of the third guide bar is 1-0/0-1//.

Preferably, in the structure of the fabric, the notation of the first guide bar is 1-0/4-5//, the notation of the second guide bar is 1-0/3-4//, and the notation of the third guide bar is 1-0/1-0//.

Preferably, in the structure of the fabric, the notation of the first guide bar is 1-0/4-5//, the notation of the second guide bar is 1-0/2-3//, and the notation of the third guide bar is 1-0/0-1//.

Preferably, in the structure of the fabric, the notation of the first guide bar is 1-0/4-5//, the notation of the second guide bar is 1-0/2-3//, and the notation of the third guide bar is 1-0/1-0//.

Preferably, in the structure of the fabric, the notation of the first guide bar is 1-0/3-4//, the notation of the second guide bar is 1-0/3-4//, and the notation of the third guide bar is 1-0/0-1//.

Preferably, in the structure of the fabric, the notation of the first guide bar is 1-0/3-4//, the notation of the second guide bar is 1-0/3-4//, and the notation of the third guide bar is 1-0/1-0//.

Preferably, in the structure of the fabric, the notation of the first guide bar is 1-0/3-4//, the notation of the second guide bar is 1-0/2-3//, and the notation of the third guide bar is 1-0/0-1//.

Preferably, in the structure of the fabric, the notation of the first guide bar is 1-0/3-4//, the notation of the second guide bar is 1-0/2-3//, and the notation of the third guide bar is 1-0/1-0//.

Preferably, the post-finishing further includes the following steps:

(4a) flame retardant finishing: immersing the fabric in a flame retardant solution and drying after patting.

A fabric with high shielding performance is obtained by the above method.

An application of the above fabric with the high shielding performance in the preparation of an advertising fabric is provided.

The advantages of the present invention are as follows.

The fabric with the high shielding performance in the present invention is prepared by skillfully combining the boiling water shrinkage features of polyester filament yarns with a special combination of guide bar knitting structures, and the surface of the finished fabric is compact enough to avoid pinhole light leakage. Thus, the problem that fabrics should be deposited with coatings to avoid light leakage is solved. The front guide bar, the back guide bar, and the middle guide bar in the fabric with the high shielding performance of the present invention use polyester textured yarn. The low-shrink molding of the polyester textured yarn and the Stenter setting in the post-finishing allow the surface of the fabric to have a smooth mirror effect. After printing the fabric, the more realistic patterns can be achieved. The fabric with the high shielding performance in the present invention is soft and has high wrinkle resistance, which avoids the case that the wrinkle affects the patterns during use. Advertising materials can be directly printed on the fabric with the high shielding performance in the present invention without a coating treatment on the fabric in advance. The pattern effect can be equivalent to the printing effect on the coated fabric.

BRIEF DESCRIPTION OF THE DRAWINGS

In order to explain the technical solutions of the embodiments in the present invention and the prior art more clearly, the drawings used in the embodiments or in the description of the prior art are briefly described below. Obviously, the drawings in the following descriptions are merely embodiments of the present invention. For those of ordinary skills in the art, other drawings can be obtained based on the provided drawings without creative labor.

Figure 1:
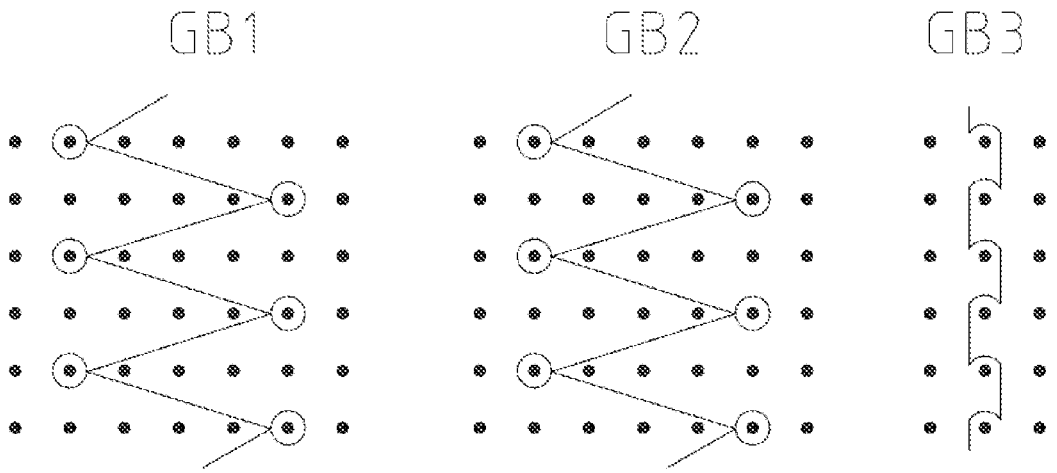
FIG. 1 is an artistic conception drawing of the fabric according to embodiment 1 in the present invention.

In the figures: GB1—first guide bar, GB2—second guide bar, and GB3—third guide bar.

DETAILED DESCRIPTION OF THE EMBODIMENTS

The technical solutions of the present invention are further described in detail below through specific embodiments and the accompanying drawings. It should be understood that the implementation of the present invention is not limited to the following embodiments. Any modifications and/or changes made to the present invention in form shall fall within the protection scope of the present invention.

In the present invention, unless otherwise specified, all parts and percentages are weight units. The devices and raw materials used are commercially available or are commonly used in the art. Unless otherwise specified, the methods in the following embodiments are conventional methods in the art. Unless otherwise specified, the components or devices in the following embodiments are universal standard parts or components known to those skilled in the art, and their structures and principles are known to those skilled in the art through technical manuals or conventional experimental methods.

The present invention provides a method for preparing a fabric with high shielding performance. The method is implemented by the following steps.

(1) Yarn selection: a polyester textured yarn with a denier ranging from 20 D to 50 D and a polyester filament yarn with a denier ranging from 20 D to 50 D are selected as the yarns.

(2) Warp-knitting: three guide bars are used for knitting in a warp knitting machine. The three guide bars are fully threaded and have a same yarn lapping movement direction. The first guide bar and the second guide bar use the polyester textured yarn for knitting in a modified warp plain fabric structure, and the third guide bar uses the polyester filament yarns for knitting in a chain-stitch fabric structure.

(3) Jet dyeing: a direct dyeing treatment is performed on greige by a jet dyeing machine.

(4) Post-finishing: a Stenter setting is performed on a Stenter setting machine.

In the present invention, the yarns are preferably selected to be a 30 D/36 F polyester textured yarn and a 30 D/72 F polyester filament yarn. The 30 D/36 F polyester textured yarn is used as the yarn for the first guide bar and the second guide bar, and lay flat on the surface of the fabric, effectively increasing the flatness of the surface of the fabric, and meanwhile covering the gaps in the fabric to the most extent, thereby improving the shielding performance of the fabric. The 30 D/72 F polyester filament yarn is used as the yarn for the third guide bar. Because the polyester filament yarn has a higher boiling water shrinkage than the polyester textured yarn, the yarn of the third guide bar shrinks and shortens during the subsequent step of jet dyeing due to its high boiling water shrinkage. Additionally, because the third guide bar knits with a chain-stitch fabric structure, the fabric has a large retraction in the longitudinal direction, which can greatly increase the loop density of the fabric in the longitudinal direction, thereby obtaining a high-density fabric with excellent shielding performance.

In the present invention, the first guide bar and the second guide bar knit with a modified warp plain fabric structure in the warp-knitting. In such a knitted structure, the extension yarn is relatively long. The longer the extension yarn, the smaller the angle between the extension yarn and the horizontal line, and the closer the yarn is to the horizontal line. After the subsequent setting of the fabric fabric surface obtained in this way, the fabric fabric surface is flat and smooth, achieving a mirror-like effect.

In the present invention, the third guide bar knits with a chain-stitch fabric structure in the warp-knitting. Both an open-loop chain-stitch fabric structure and a closed-loop chain-stitch fabric structure may be used. There are no extension yarns connected to each other between the horizontal direction and vertical direction in the chain-stitch fabric structure. The polyester filament yarn is selected to achieve a longitudinal shrinkage of the fabric during knitting, thereby increasing the longitudinal density of the fabric.

In the present invention, the three guide bars have a same yarn lapping movement direction in the warp knitting, which makes the fabric have increased longitudinal density. The principle is as follows. The loop obtained by the three guide bars having a same yarn lapping movement direction is obviously different from that obtained by the three guide bars having a reverse yarn lapping movement direction. In the reverse-directional yarn lapping movement, due to the different directions of the extension yarns, the left and right pulling forces of the extension yarns to the loops are basically balanced. The loops in this structure are vertical in the longitudinal direction. However, in the structure of co-directional yarn lapping movement, extension yarns in the first row all face left. The extension yarns apply a left pulling force on the loop. The loop pillar on the right side of the loop begins to shrink and shorten after being pulled, and the loop tilts to the right. The extension yarns in the second row apply a right pulling force on the loop. The loop pillar on the left side of the loop of the second row is shortened due to the pulling force, and the loop tilts to the left. Namely, the first row in this structure tilts to the left and the second row tilts to the right. The tilt of the loop results in an increased longitudinal density.

In the present invention, during the jet dyeing, greige is processed with a direct dyeing, so that the greige is retracted to the most extent in the longitudinal and transverse directions of the fabric in the jet dyeing machine to obtain a fabric with a relatively great longitudinal density. The specific method of the direct dyeing process for greige is not particularly limited in the present invention. Technical solutions of direct dyeing for greige that are well known to those skilled in the art may be used.

In the present invention, in the post-finishing, a Stenter setting is performed to the most extent in the transverse direction of the fabric. Meanwhile, the longitudinal density is increased in the over-feed, so that the yarns in the fabric are straightened, and the extension yarns are basically horizontal. Thus, a flat and smooth surface effect is achieved.

In the present invention, to achieve a better flame retardant effect of the fabric, the post-finishing may further include the following steps:

(4a) Flame retardant finishing: the fabric is immersed in a flame retardant solution and is dried after padding.

The purpose of the above flame retardant finishing is to ensure that the fabric is highly flame retardant. The present invention has no particular limitation on the specific method of the flame retardant finishing. The technical solutions of flame retardant finishing in fabric processing that are well known to those skilled in the art may be used.

In the present invention, to achieve a better fabric printing effect, the post-finishing may further include the following steps:

(4b) Penetration finishing.

The purpose of the above penetration finishing is to improve the color absorption property and penetration property of the fabric to the printing paste, and ensure that the fabric has an excellent printing effect. The present invention has no particular limitation on the specific method of penetration finishing. The technical solutions of penetration finishing in fabric processing that are well known to those skilled in the art may be used.

The present invention provides a fabric with high shielding performance, which is prepared according to the method described above. The fabric was tested for transmittance and reflectance, and the shielding ratio thereof was calculated to be greater than 70%, showing that the fabric has relatively high shielding performance. The flame retardant test was performed on the fabric. The droplet burning time was less than or equal to 2 seconds, and the weight loss rate was less than or equal to 40%. The results show that the fabric is qualified in the flame retardant test.

The invention provides an application of the above fabric with the high shielding performance in the preparation of an advertising fabric. In the present invention, the advertising fabric may be prepared entirely from the fabric with the high shielding performance described in the above technical solution, or may be prepared partially from the fabric with the high shielding performance described in the above technical solution. Advertising fabrics have requirements for fabric shielding, flame retardancy, and printability. The above-mentioned fabric with the high shielding performance can fully meet the requirements of advertising fabrics.

The raw materials and devices used in the following embodiments of the present invention are all commercially available products. The knitting machine used in warp-knitting is HKS3 Warp Knitting Machine.

Embodiment 1

A method for preparing a fabric with high shielding performance is provided. The method includes the following steps.

(1) Yarn selection: a polyester textured yarn with a denier of 30 D/36 F and a polyester filament yarn with a denier of 30 D/72 F are selected as the yarns.

(2) Warp-knitting: three guide bars are used for knitting in a warp knitting machine. The three guide bars are fully threaded and have a same yarn lapping movement direction. The first guide bar and the second guide bar use the polyester textured yarn, the third guide bar uses the polyester filament yarns, and the third guide bar knits with a chain-stitch fabric structure. Specifically, the notation of the first guide bar is 1-0/4-5//, the notation of the second guide bar is 1-0/4-5//, and the notation of the third guide bar is 1-0/0-1//. The artistic conception drawing is shown in FIG. 1.

(3) Jet dyeing: a direct dyeing treatment is performed on greige by a jet dyeing machine.

(4) Post-finishing: a Stenter setting is performed on a Stenter setting machine.

(4a) Flame retardant finishing: the fabric is immersed in a flame retardant solution and is dried after padding.

(4b) Penetration finishing.

In the warp-knitting, the first guide bar has a notation of 1-0/4-5//, the second guide bar has a notation of 1-0/4-5//, and they both knit with a modified warp plain fabric structure. The third guide bar has a notation of 1-0/0-1//, which knits with an open-loop chain-stitch fabric structure.

A fabric with high shielding performance is obtained by the above method.

Technical indicators of the fabric with the high shielding performance obtained in embodiment 1 of the present invention were tested and the results are shown in Table 1.

TABLE 1

Test data of the fabric with the high shielding performance

| Technical indicators | | Embodiment 1 | Embodiment 5 |
|---|---|---|---|
| Weight (gsm) | | 243 | 228 |
| Width (cm) | | 322 | 324 |
| Elongation of Fabric Length (%): | | 8.4% | 4.3% |
| Elongation of Fabric Width (%): | | 0.8% | 1.4% |
| Permeability: evaluation of printing effect | | Good | Good |
| Shielding ratio: % | | 71 | 70 |
| Flame retardancy (meet both) | Droplet burning time ≤ 2 s | 0 s | 1.5 s |
| | Weight loss rate ≤ 40% | 4.3% | 10.3% |

Embodiment 2

A method for preparing a fabric with high shielding performance is provided. The method includes the following steps.

(1) Yarn selection: a polyester textured yarn with a denier of 30 D/36 F and a polyester filament yarn with a denier of 30 D/72 F are selected as the yarns.

Figure 2:
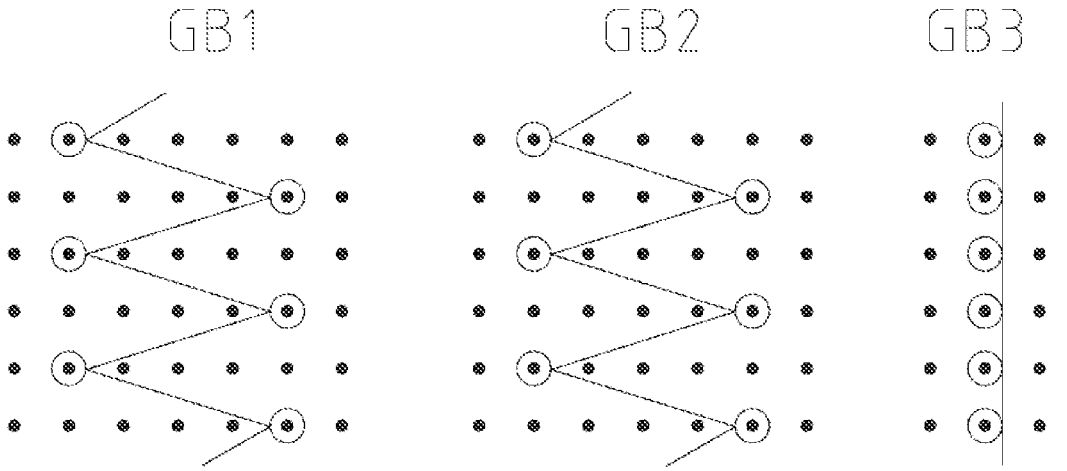
FIG. 2 is an artistic conception drawing of the fabric according to embodiment 2 in the present invention.

(2) Warp-knitting: three guide bars are used for knitting in a warp knitting machine. The three guide bars are fully threaded and have a same yarn lapping movement direction. The first guide bar and the second guide bar use the polyester textured yarn, the third guide bar uses the polyester filament yarns, and the third guide bar knits with a chain-stitch fabric structure. Specifically, the notation of the first guide bar is 1-0/4-5//, the notation of the second guide bar is 1-0/4-5//, and the notation of the third guide bar is 1-0/1-0//. The artistic conception drawing is shown in FIG. 2.

(3) Jet dyeing: a direct dyeing treatment is performed on greige by a jet dyeing machine.

(4) Post-finishing: a Stenter setting is performed on a Stenter setting machine.

(4a) Flame retardant finishing: the fabric is immersed in a flame retardant solution and is dried after padding.

(4b) Penetration finishing.

In the warp-knitting, the first guide bar has a notation of 1-0/4-5//, the second guide bar has a notation of 1-0/4-5//, and they both knit with a modified warp plain fabric structure. The third guide bar has a notation of 1-0/1-0//, which knits with a closed-loop chain-stitch fabric structure.

A fabric with high shielding performance is obtained by the above method.

Embodiment 3

A method for preparing a fabric with high shielding performance is provided. The method includes the following steps.

(1) Yarn selection: a polyester textured yarn with a denier of 30 D/36 F and a polyester filament yarn with a denier of 30 D/72 F are selected as the yarns.

(2) Warp-knitting: three guide bars are used for knitting in a warp knitting machine. The three guide bars are fully threaded and have a same yarn lapping movement direction.

Figure 3:
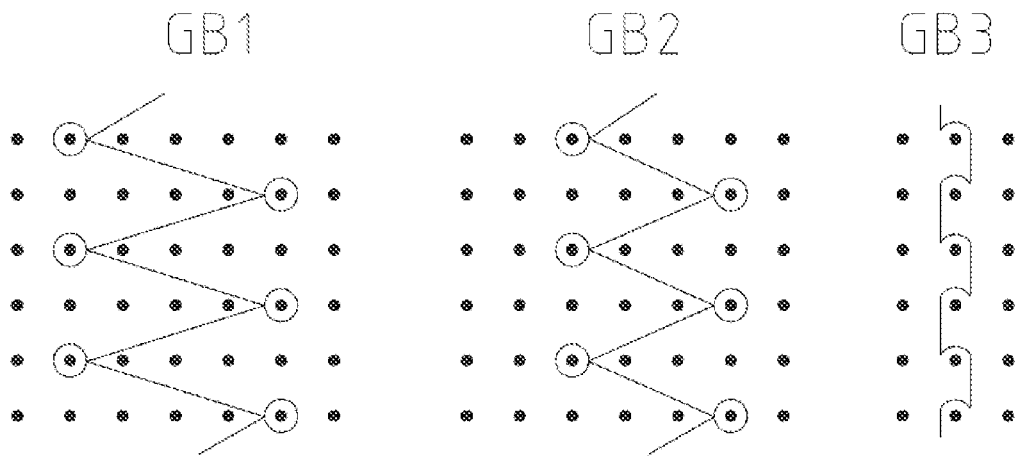
FIG. 3 is an artistic conception drawing of the fabric according to embodiment 3 in the present invention.

The first guide bar and the second guide bar use the polyester textured yarn, the third guide bar uses the polyester filament yarns, and the third guide bar knits with a chain-stitch fabric structure. Specifically, the notation of the first guide bar is 1-0/4-5//, the notation of the second guide bar is 1-0/3-4//, and the notation of the third guide bar is 1-0/0-1//. The artistic conception drawing is shown in FIG. 3.

(3) Jet dyeing: a direct dyeing treatment is performed on greige by a jet dyeing machine.

(4) Post-finishing: a Stenter setting is performed on a Stenter setting machine.

(4a) Flame retardant finishing: the fabric is immersed in a flame retardant solution and is dried after patting.

(4b) Penetration finishing.

In the warp-knitting, the first guide bar has a notation of 1-0/4-5//. The second guide bar has a notation of 1-0/3-4//. The first guide bar knits with a modified warp plain fabric structure. The second guide bar knits with a warp twill fabric structure. The third guide bar has a notation of 1-0/0-1//, which knits with an open-loop chain-stitch fabric structure.

A fabric with high shielding performance is obtained by the above method.

Embodiment 4

A method for preparing a fabric with high shielding performance is provided. The method includes the following steps.

(1) Yarn selection: a polyester textured yarn with a denier of 30 D/36 F and a polyester filament yarn with a denier of 30 D/72 F are selected as the yarns.

(2) Warp-knitting: three guide bars are used for knitting in a warp knitting machine. The three guide bars are fully threaded and have a same yarn lapping movement direction.

Figure 4:
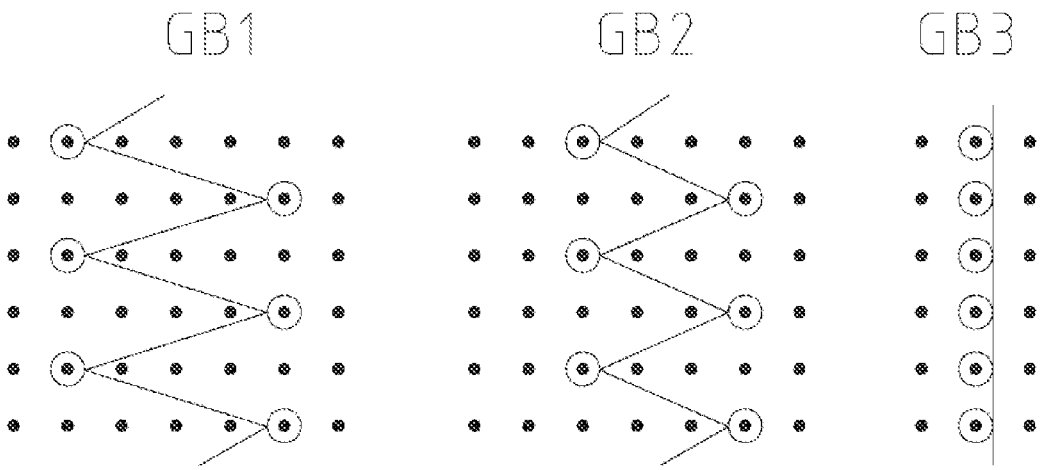
FIG. 4 is an artistic conception drawing of the fabric according to embodiment 4 in the present invention.

The first guide bar and the second guide bar use the polyester textured yarn, the third guide bar uses the polyester filament yarn, and the third guide bar knits with a chain-stitch fabric structure. Specifically, the notation of the first guide bar is 1-0/4-5//, the notation of the second guide bar is 1-0/3-4//, and the notation of the third guide bar is 1-0/1-0//. The artistic conception drawing is shown in FIG. 4.

(3) Jet dyeing: a direct dyeing treatment is performed on greige by a jet dyeing machine.

(4) Post-finishing: a Stenter setting is performed on a Stenter setting machine.

(4a) Flame retardant finishing: the fabric is immersed in a flame retardant solution and is dried after patting.

(4b) Penetration finishing.

In the warp-knitting, the first guide bar has a notation of 1-0/4-5//. The second guide bar has a notation of 1-0/3-4//. The first guide bar knits with a modified warp plain fabric structure. The second guide bar knits with a warp twill fabric structure. The third guide bar has a notation of 1-0/1-0//, which knits with a closed-loop chain-stitch fabric structure.

A fabric with high shielding performance is obtained by the above method.

Embodiment 5

A method for preparing a fabric with high shielding performance is provided. The method includes the following steps.

(1) Yarn selection: a polyester textured yarn with a denier of 30 D/36 F and a polyester filament yarn with a denier of 30 D/72 F are selected as the yarns.

Figure 5:
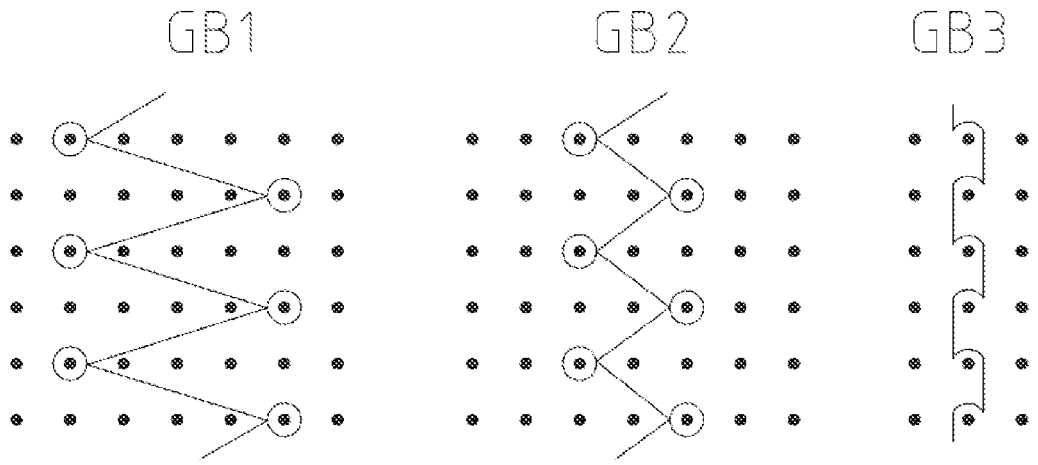
FIG. 5 is an artistic conception drawing of the fabric according to embodiment 5 in the present invention.

(2) Warp-knitting: three guide bars are used for knitting in a warp knitting machine. The three guide bars are fully threaded and have a same yarn lapping movement direction. The first guide bar and the second guide bar use the polyester textured yarn, the third guide bar uses the polyester filament yarn, and the third guide bar knits with a chain-stitch fabric structure. Specifically, the notation of the first guide bar is 1-0/4-5//, the notation of the second guide bar is 1-0/2-3//, and the notation of the third guide bar is 1-0/0-1//. The artistic conception drawing is shown in FIG. 5.

(3) Jet dyeing: a direct dyeing treatment is performed on greige by a jet dyeing machine.

(4) Post-finishing: a Stenter setting is performed on a Stenter setting machine.

(4a) Flame retardant finishing: the fabric is immersed in a flame retardant solution and is dried after patting.

(4b) Penetration finishing.

In the warp-knitting, the first guide bar has a notation of 1-0/4-5//. The second guide bar has a notation of 1-0/2-3//. The first guide bar knits with a modified warp plain fabric structure. The second guide bar knits with a warp pile fabric structure. The third guide bar has a notation of 1-0/0-1//, which knits with an open-loop chain-stitch fabric structure.

A fabric with high shielding performance is obtained by the above method.

Technical indicators of the fabric with the high shielding performance obtained in embodiment 5 of the present invention were tested and the results are shown in Table 1.

Embodiment 6

A method for preparing a fabric with high shielding performance is provided. The method includes the following steps.

(1) Yarn selection: a polyester textured yarn with a denier of 30 D/36 F and a polyester filament yarn with a denier of 30 D/72 F are selected as the yarns.

Figure 6:
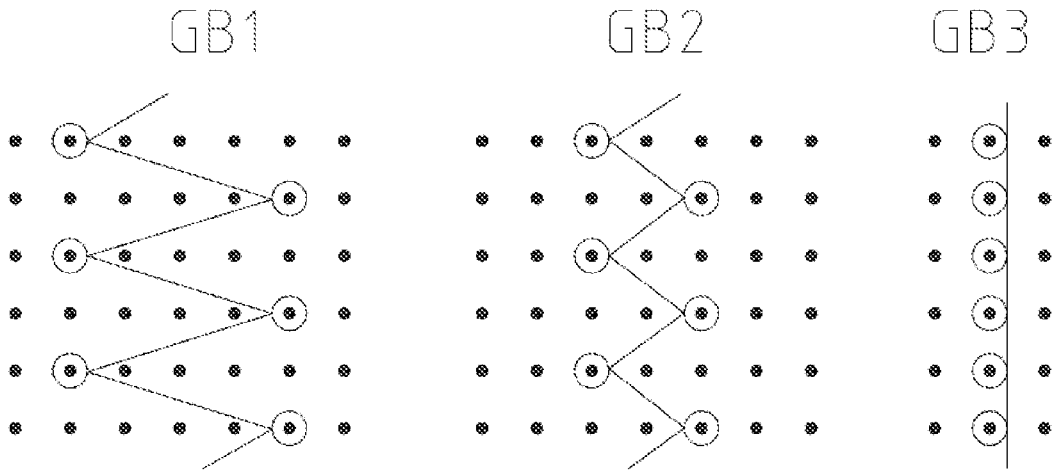
FIG. 6 is an artistic conception drawing of the fabric according to embodiment 6 in the present invention.

(2) Warp-knitting: three guide bars are used for knitting in a warp knitting machine. The three guide bars are fully threaded and have a same yarn lapping movement direction. The first guide bar and the second guide bar use the polyester textured yarn, the third guide bar uses the polyester filament yarn, and the third guide bar knits with a chain-stitch fabric structure. Specifically, the notation of the first guide bar is 1-0/4-5//, the notation of the second guide bar is 1-0/2-3//, and the notation of the third guide bar is 1-0/1-0//. The artistic conception drawing is shown in FIG. 6.

(3) Jet dyeing: a direct dyeing treatment is performed on greige by a jet dyeing machine.

(4) Post-finishing: a Stenter setting is performed on a Stenter setting machine.

(4a) Flame retardant finishing: the fabric is immersed in a flame retardant solution and is dried after padding.

(4b) Penetration finishing.

In the warp-knitting, the first guide bar has a notation of 1-0/4-5//. The second guide bar has a notation of 1-0/2-3//. The first guide bar knits with a modified warp plain fabric structure. The second guide bar knits with a warp pile fabric structure. The third guide bar has a notation of 1-0/1-0//, which knits with a closed-loop chain-stitch fabric structure.

A fabric with high shielding performance is obtained by the above method.

Embodiment 7

A method for preparing a fabric with high shielding performance is provided. The method includes the following steps.

(1) Yarn selection: a polyester textured yarn with a denier of 30 D/36 F and a polyester filament yarn with a denier of 30 D/72 F are selected as the yarns.

Figure 7:
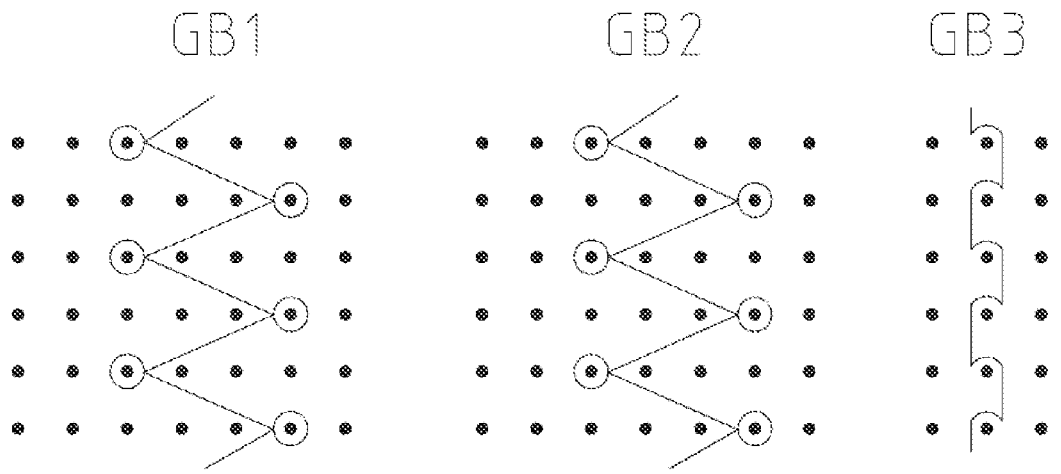
FIG. 7 is an artistic conception drawing of the fabric according to embodiment 7 in the present invention.

(2) Warp-knitting: three guide bars are used for knitting in a warp knitting machine. The three guide bars are fully threaded and have a same yarn lapping movement direction. The first guide bar and the second guide bar use the polyester textured yarn, the third guide bar uses the polyester filament yarn, and the third guide bar knits with a chain-stitch fabric structure. Specifically, the notation of the first guide bar is 1-0/3-4//, the notation of the second guide bar is 1-0/3-4//, and the notation of the third guide bar is 1-0/0-1//. The artistic conception drawing is shown in FIG. 7.

(3) Jet dyeing: a direct dyeing treatment is performed on greige by a jet dyeing machine.

(4) Post-finishing: a Stenter setting is performed on a Stenter setting machine.

(4a) Flame retardant finishing: the fabric is immersed in a flame retardant solution and is dried after padding.

(4b) Penetration finishing.

In the warp-knitting, the first guide bar has a notation of 1-0/3-4//, the second guide bar has a notation of 1-0/3-4//, and they both knit with a warp twill fabric structure. The third guide bar has a notation of 1-0/0-1//, which knits with an open-loop chain-stitch fabric structure.

A fabric with high shielding performance is obtained by the above method.

Embodiment 8

A method for preparing a fabric with high shielding performance is provided. The method includes the following steps.

(1) Yarn selection: a polyester textured yarn with a denier of 30 D/36 F and a polyester filament yarn with a denier of 30 D/72 F are selected as the yarns.

Figure 8:
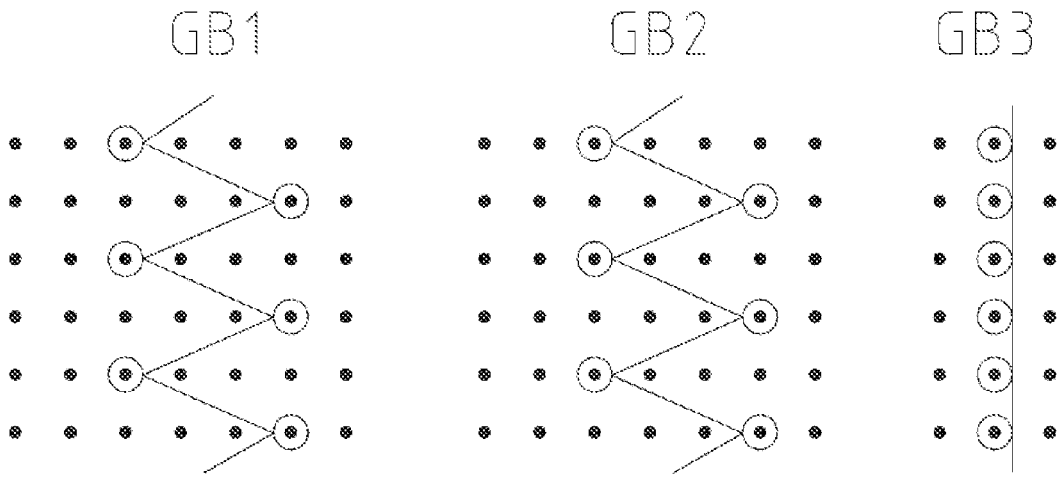
FIG. 8 is an artistic conception drawing of the fabric according to embodiment 8 in the present invention.

(2) Warp-knitting: three guide bars are used for knitting in a warp knitting machine. The three guide bars are fully threaded and have a same yarn lapping movement direction. The first guide bar and the second guide bar use the polyester textured yarn, the third guide bar uses the polyester filament yarns, and the third guide bar knits with a chain-stitch fabric structure. Specifically, the notation of the first guide bar is 1-0/3-4//, the notation of the second guide bar is 1-0/3-4//, and the notation of the third guide bar is 1-0/1-0//. The artistic conception drawing is shown in FIG. 8.

(3) Jet dyeing: a direct dyeing treatment is performed on greige by a jet dyeing machine.

(4) Post-finishing: a Stenter setting is performed on a Stenter setting machine.

(4a) Flame retardant finishing: the fabric is immersed in a flame retardant solution and is dried after patting.

(4b) Penetration finishing.

In the warp-knitting, the first guide bar has a notation of 1-0/3-4//, the second guide bar has a notation of 1-0/3-4//, and they both knit with a warp twill fabric structure. The third guide bar has a notation of 1-0/1-0//, which knits with a closed-loop chain-stitch fabric structure.

A fabric with high shielding performance is obtained by the above method.

Embodiment 9

A method for preparing a fabric with high shielding performance is provided. The method includes the following steps.

(1) Yarn selection: a polyester textured yarn with a denier of 30 D/36 F and a polyester filament yarn with a denier of 30 D/72 F are selected as the yarns.

Figure 9:
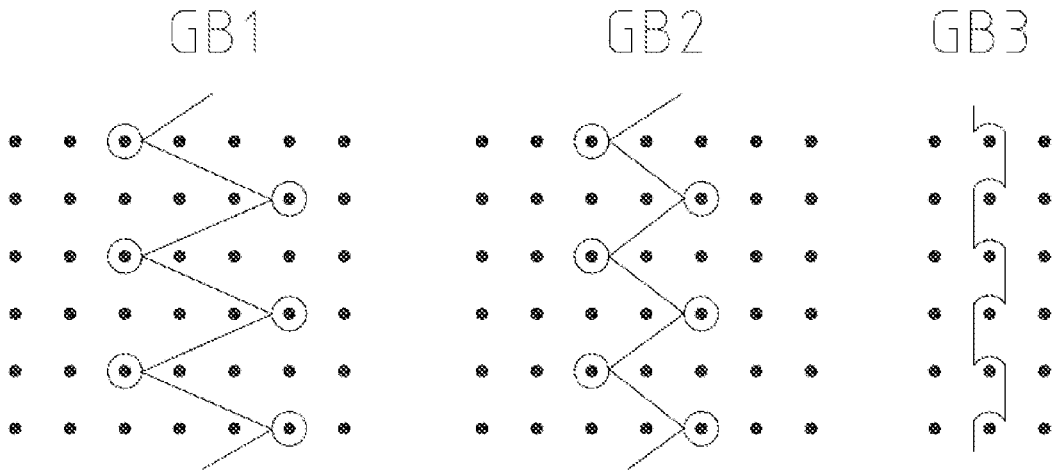
FIG. 9 is an artistic conception drawing of the fabric according to embodiment 9 in the present invention.

(2) Warp-knitting: three guide bars are used for knitting in a warp knitting machine. The three guide bars are fully threaded and have a same yarn lapping movement direction. The first guide bar and the second guide bar use the polyester textured yarn, the third guide bar uses the polyester filament yarn, and the third guide bar knits with a chain-stitch fabric structure. Specifically, the notation of the first guide bar is 1-0/3-4//, the notation of the second guide bar is 1-0/2-3//, and the notation of the third guide bar is 1-0/0-1//. The artistic conception drawing is shown in FIG. 9.

(3) Jet dyeing: a direct dyeing treatment is performed on greige by a jet dyeing machine.

(4) Post-finishing: a Stenter setting is performed on a setting machine.

(4a) Flame retardant finishing: the fabric is immersed in a flame retardant solution and is dried after patting.

(4b) Penetration finishing.

In the warp-knitting, the first guide bar has a notation of 1-0/3-4//, and the second guide bar has a notation of 1-0/2-3//. The first guide bar knits with a warp twill fabric structure. The second guide bar knits with a warp pile fabric structure. The third guide bar has a notation of 1-0/0-1//, which knits with an open-loop chain-stitch fabric structure.

A fabric with high shielding performance is obtained by the above method.

Embodiment 10

A method for preparing a fabric with high shielding performance is provided. The method includes the following steps.

(1) Yarn selection: a polyester textured yarn with a denier of 30 D/36 F and a polyester filament yarn with a denier of 30 D/72 F are selected as the yarns.

Figure 10:
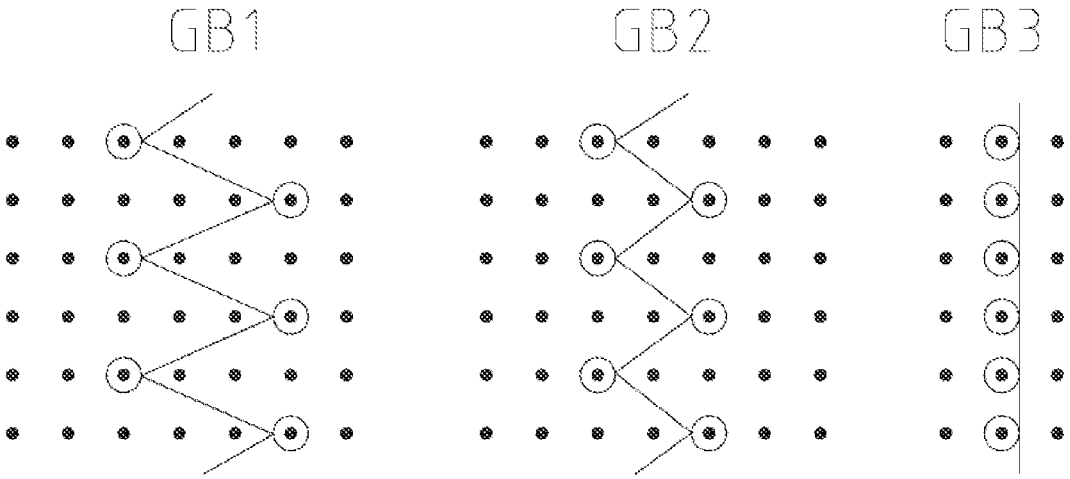
FIG. 10 is an artistic conception drawing of the fabric according to embodiment 10 in the present invention.

(2) Warp-knitting: three guide bars are used for knitting in a warp knitting machine. The three guide bars are fully threaded and have a same yarn lapping movement direction. The first guide bar and the second guide bar use the polyester textured yarn, the third guide bar uses the polyester filament yarn, and the third guide bar knits with a chain-stitch fabric structure. Specifically, the notation of the first guide bar is 1-0/3-4//, the notation of the second guide bar is 1-0/2-3//, and the notation of the third guide bar is 1-0/1-0//. The artistic conception drawing is shown in FIG. 10.

(3) Jet dyeing: a direct dyeing treatment is performed on greige by a jet dyeing machine.

(4) Post-finishing: a Stenter setting is performed on a Stenter setting machine.

(4a) Flame retardant finishing: the fabric is immersed in a flame retardant solution and is dried after patting.

(4b) Penetration finishing.

In the warp-knitting, the first guide bar has a notation of 1-0/3-4//, and the second guide bar has a notation of 1-0/2-3//. The first guide bar knits with a warp twill fabric structure. The second guide bar knits with a warp pile fabric structure. The third guide bar has a notation of 1-0/1-0//, which knits with a closed-loop chain-stitch fabric structure.

A fabric with high shielding performance is obtained by the above method.

Embodiments 11-18

A method for preparing a fabric with high shielding performance is provided. The process steps of this method are the same as those in Embodiment 1, except for the selection of the yarns and the setting of the notations. Specifically, 8 groups of yarns with different specifications are selected for production as follows:

Embodiment 11: Polyester (P) 20 D/48 F+P 20 D/48 F+P 20 D/12 F (These are the yarns used for the first, second, and third guide bars in sequence, wherein the first and second guide bars use the polyester textured yarn, and the third guide bar uses the polyester filament yarn, similarly hereinafter.)

The first guide bar has a notation of 1-0/4-5//, the second guide bar has a notation of 1-0/4-5//, and the third guide bar has a notation of 1-0/1-0//.

Embodiment 12: P 20 D/48 F+P 20 D/48 F+P 20 D/12 F

The first guide bar has a notation of 1-0/4-5//, the second guide bar has a notation of 1-0/3-4//, and the third guide bar has a notation of 1-0/0-1//.

Embodiment 13: P 50 D/144 F+P 50 D/144 F+P 50 D/24 F

The first guide bar has a notation of 1-0/4-5//, the second guide bar has a notation of 1-0/3-4//, and the third guide bar has a notation of 1-0/1-0//.

Embodiment 14: P 50 D/144 F+P 50 D/144 F+P 30 D/72 F

The first guide bar has a notation of 1-0/4-5//, the second guide bar has a notation of 1-0/2-3//, and the third guide bar has a notation of 1-0/1-0//.

Embodiment 15: P 50 D/144 F+P 50 D/144 F+P 20 D/12 F

The first guide bar has a notation of 1-0/3-4//, the second guide bar has a notation of 1-0/3-4//, and the third guide bar has a notation of 1-0/0-1//.

Embodiment 16: P 20 D/48 F+P 20 D/48 F+P 20 D/1 F

The first guide bar has a notation of 1-0/3-4//, the second guide bar has a notation of 1-0/3-4//, and the third guide bar has a notation of 1-0/1-0//.

Embodiment 17: P 50 D/144 F+P 50 D/144 F+P 40 D/24 F

The first guide bar has a notation of 1-0/3-4//, the second guide bar has a notation of 1-0/2-3//, and the third guide bar has a notation of 1-0/0-1//.

Embodiment 18: P 50 D/144 F+P 30 D/36 F+P 30 D/72 F

The first guide bar has a notation of 1-0/3-4//, the second guide bar has a notation of 1-0/2-3//, and the third guide bar has a notation of 1-0/1-0//.

Embodiment 19: P 20 D/12 F+P 20 D/12 F+P 50 D/144 F

The first guide bar has a notation of 1-0/4-5//, the second guide bar has a notation of 1-0/4-5//, and the third guide bar has a notation of 1-0/1-0//.

Technical indicators of the 9 groups of the fabrics with the high shielding performance obtained in above embodiments were tested and the results are shown in Table 2.

TABLE 2

Test data of the fabrics with the high shielding performance

| Embodiment | | 11 | 12 | 13 | 14 | 15 | 16 | 17 | 18 | 19 |
|---|---|---|---|---|---|---|---|---|---|---|
| Weight (gsm) | | 151 | 145 | 315 | 357 | 338 | 147 | 319 | 255 | 193 |
| Width (cm) | | 324 | 322 | 322 | 322 | 324 | 322 | 322 | 321 | 316 |
| Elongation of Fabric Length (%): | | 1.4% | 1.4% | 3.2% | 6.7% | 7.1% | 9.1% | 4.7% | 2.7% | 4.4 |
| Elongation of Fabric Width (%): | | 0.9% | 0.8% | 1.3% | 0.9% | 0.7% | 0.7% | 1.6% | 0.9% | 1.3 |
| Permeability: evaluation of printing effect | | Good | Good | Good | Good | Good | Good | Good | Good | Good |
| Shielding ratio: % | | 66 | 66 | 79 | 82 | 81 | 66 | 79 | 75 | 68 |
| Flame retardancy (meet both) | Droplet burning time ≤2 s | 1.6 s | 1.4 s | 0 s | 0 s | 0 s | 1.5 s | 1 s | 1.2 s | 0.9 s |
| | Weight loss rate ≤40% | 10.1% | 12.0% | 1.8% | 2.1% | 9.3% | 11.8% | 2.5% | 10.2% | 8.7% |

In Embodiment 11, the advertising fabric with a fabric weight of 150 gsm is developed by using relatively thin polyesters including 20 D/48 F polyester textured yarn and 20 D/12F polyester filament yarn. Meanwhile, the fabric structure is adjusted, namely, the fabric of the third guide bar is changed to be the chain-stitch fabric, so as to compare the compactness of the fabric. From the test results, when using the 20 D polyester yarn, under the conditions that the number of yarn filaments and fabric structure are different, the fabric has a smooth appearance and meets the design requirements. The fabric coils are dense and the shielding ratio is 66%, which fully meets the requirements of advertising fabrics (shielding ratio ≥54%).

The yarns of Embodiment 12 are the same as those of Embodiment 11, but the fabric structure is adjusted, namely, the length of the extension yarn of GB2 is reduced by one stitch length, where 1-0/4-5// is changed to be 1-0/3-4//. Meanwhile, the fabric structure of GB3 is changed back to be closed-loop chain-stitch: 1-0/0-1//, so as to verify the changes in fabric surface, fabric weight and shielding performance. From the test results, the fabric weight of the fabric becomes smaller, the appearance of the fabric is flat and smooth, and the shielding ratio is 66%, which does not decrease and meets the use requirements.

Embodiment 13 keeps the fabric structure the same as in Embodiment 11 and uses thicker polyester yarns, namely, GB1 and GB2 use P 50 D/144 F polyester textured yarn, and GB3 uses P 50 D/24 F polyester filament yarn. The yarn denier and the number of yarn filaments increase. The purpose is to develop a thick advertising fabric with high shielding performance. From the test results, as the denier of the yarn and the number of yarn filaments increase, the smooth finish of the fabric surface slightly decreases, but the fabric weight of the fabric increases significantly (315 gsm), and the shielding ratio improves significantly (79%). The fabric meets the use requirements.

Embodiment 14 differs from Embodiment 13 in that: the extension yarn of GB2 is shortened by two stitch lengths to verify the effect of short extension yarn on the shielding performance of the fabric. Meanwhile, the yarn of GB3 is changed to be P 30 D/72 F, in order to use the fine yarn to increase the longitudinal shrinkage of the fabric during dyeing, thereby increasing the longitudinal density of the fabric and thus increasing the shielding performance of the fabric. From the test results, the extension yarn of GB2 is shortened by two stitch lengths, which has no obvious effect on the shielding performance of the fabric. However, the reduced denier of the yarn of GB3 has a greater effect on the physical properties of the fabric, namely, the fabric weight of the fabric increases to 357 gsm. Meanwhile, the shielding ratio also increases slightly to reach 82%. This shielding performance indicator is excellent and has far exceeded the requirements of advertising fabrics (shielding ratio ≥54%). Obviously, the higher the shielding performance, the better the advertising fabrics.

In Embodiment 15, a novel structure is tested: the notation of GB1 is adjusted from 1-0/4-5// to 1-0/3-4//, that is, the extension yarn of GB1 is shorten by one stitch length. Meanwhile, the notation of GB2 is also adjusted to be 1-0/3-4//. The purpose is to verify the change in the appearance of the fabric and the change in the shielding performance. From the test results, due to the shortening of the extension yarn, the smooth finish of the fabric is slightly improved, and the shielding performance is good. Other physical indicators meet the use requirements as well.

Embodiment 16 differs from Embodiment 15 as follows: GB1 and GB2 use P 20 D/48 F polyester textured yarn, and GB3 uses P 20 D/1 F polyester filament yarn, so as to verify the effect of finer yarns on the fabric performance under this fabric structure. From the test results: the appearance of the fabric is dense, flat and smooth. In the condition of small fabric weight (147 gsm) of the fabric, the shielding ratio (66%) of the fabric is still satisfactory. However, as the denier of the yarn decreases, the fabric becomes lighter and thinner, and the shielding performance is also reduced to a certain extent.

In Embodiment 17, a novel fabric structure is tested. Compared with Embodiment 16, the notation of GB1 is unchangeably 1-0/3-4//. However, the notation of GB2 is shortened by one stitch length to be 1-0/2-3//. Meanwhile, the yarns of GB1 and GB2 are P 50 D/144 F polyester textured yarn, and GB3 uses 40 D/24 F polyester filament yarn. The purpose is to test the effect of the novel fabric structure on fabric properties. From the test results, as the denier of the yarns of GB1 and GB2 and the number of yarn filaments increase, the smooth finish of the fabric surface decreases to a certain extent, but the use requirements are still satisfied. The fabric weight of the fabric increases (319 gsm), the shielding ratio of the fabric is good (79%), and other physical indicators meet the use requirements as well.

Embodiment 18 uses the same fabric structure as in Embodiment 17 except that the yarns are replaced, namely, the yarn of GB1 is unchanged, the yarn of GB2 is replaced with P 30/36 F polyester textured yarn, and the yarn of GB3 is replaced with P 30 D/72 F polyester filament yarn, in order to reduce the weight of the fabric for a lower cost. From the test results, the appearance of the fabric is almost the same as that of Embodiment 17, which shows that the appearance of the fabric is more affected by the yarn of GB1. The fabric weight of the fabric is significantly lower than that of Embodiment 17, which is 255 gsm. The shielding ratio slightly reduces to be 75%, which is still excellent. Other physical indicators meet the use requirements.

Embodiment 19 uses the same fabric structure as that in Embodiment 11 except that the yarn of GB1 and GB2 is replaced with 20/12 semi-dull textured yarn, the denier remains the same, but the number of yarn filaments decreases. Meanwhile, the yarn of GB3 is replaced with P 50 D/144 filament, the denier of the yarn becomes thicker, and the number of yarn filaments increases synchronously, which has economic performance, and better shielding performance by slightly increasing the weight of the fabric. From the test results, the appearance of the fabric is flatter and smoother than that of Embodiment 3, which shows that the denier of the GB3 yarn also has an effect on the appearance of the fabric, and the yarn of the bottom guide bar is thicker, which has a better supporting effect on the fabric surface and makes the fabric surface flatter; the fabric weight of the fabric is increased from 42 gsm to 193 gsm compared with Embodiment 11; the shielding performance is slightly improved to be 68%. Other physical indicators meet the use requirements.

The denier of the yarn used in Embodiments 1-19 varies from 20 D to 50 D, and the number of yarn filaments varies from 1 F to 144 F. Meanwhile, different fabric structures are tested in various embodiments. The test results of these embodiments show that various advertising fabrics with different fabric weights, different styles, and high shielding performance can be designed and produced when the yarn denier is within the range of 20 D-50 D and the number of yarn filaments is within the range of 1 F-144 F.

The yarn denier of Embodiment 1 is 30 D, the fabric weight of the product is 243 gsm, and the shielding ratio is 71%; while the yarn denier of embodiment 11 is 20 D, the fabric weight of the product is 151 gsm, and the shielding ratio is 66%. Comparing the test results of Embodiment 1 and Embodiment 11, it is found that when the yarn becomes thinner, the fabric weight of the fabric becomes smaller; although the shielding performance of the fabric decreases slightly, it does not change much. Therefore, it can be concluded that on the basis of Embodiment 11, if the yarn denier is changed from 20 D to 15 D, satisfactory shielding performance can still be obtained, but the fabric weight of the fabric will be reduced. Therefore, the yarn denier of 15 D still meets the needs of the present invention, and the purpose of the present invention can be achieved.

Comparative Example 1

A fabric is prepared according to the following methods.

(1) Yarn selection: a polyester textured yarn with a denier of 30 D/36 F is selected as the yarn.

(2) Warp-knitting: three guide bars are used for knitting in a warp knitting machine. The three guide bars all use the polyester textured yarn. The third guide bar knits with a chain-stitch fabric structure. Specifically, the notation of the first guide bar is 1-0/4-5//, the notation of the second guide bar is 1-0/2-3//, and the notation of the third guide bar is 1-0/0-1//.

(3) Jet dyeing: a direct dyeing treatment is performed on greige by a jet dyeing machine.

(4) Post-finishing: a Stenter setting is performed on a Stenter setting machine.

In the warp-knitting, the run-in of the first guide bar is 1910 mm/rack, the run-in the second guide bar is 1300 mm/rack, and the run-in the third guide bar is 840 mm/rack. The drawing density on the machine reaches 44.6 row/cm. The flatness and brightness of the surface of the fabric of comparative example 1 prepared according to the above method meet requirements, but the grey fabric is loose, the longitudinal density is relatively low, and the fabric weight of the grey fabric is relatively small.

Comparative Example 2

A fabric is prepared according to the following methods.

(1) Yarn selection: a polyester high elastic yarn with a denier of 30 D/36 F is selected as the yarn.

(2) Warp-knitting: three guide bars are used for knitting in a warp knitting machine. The three guide bars all use the polyester textured yarn. The third guide bar knits with a chain-stitch fabric structure. Specifically, the notation of the first guide bar is 1-0/4-5//, the notation of the second guide bar is 1-0/2-3//, and the notation of the third guide bar is 1-0/0-1//.

(3) Jet dyeing: a direct dyeing treatment is performed on greige by a jet dyeing machine.

(4) Post-finishing: a Stenter setting is performed on a Stenter setting machine.

The flatness and brightness of the surface of the fabric of comparative example 2 prepared according to the above method meet requirements, but the grey fabric is loose, the longitudinal density is relatively low, and the fabric weight of the grey fabric is relatively small.

According to the above embodiments and comparative examples, it can be seen that in the preparation method of the present invention, suitable yarns are selected with the feature that the boiling water shrinkage of the polyester filament yarn is about 3% higher than that of polyester textured yarn, which increases the retraction of the fabric in the subsequent processing to obtain a finished fabric with a relatively high longitudinal density and a required shielding ratio and fabric weight. In the preparation method of the present invention, suitable guide bar-knitting structures are selected in the warp-knitting to further obtain a relatively high longitudinal density and surface flatness of the fabric. The embodiments described above are merely preferred solutions of the present invention, and do not limit the present invention in any form. There are other variations and modifications without exceeding the technical solutions described in the claims.

What is claimed is:

1. A method for preparing a fabric with high shielding performance, comprising the following steps:

(1) yarn selection: selecting a polyester textured yarn with a denier ranging from 15 D to 50 D and a polyester filament yarn with a denier ranging from 15 D to 50 D as yarns;

(2) warp-knitting: knitting the yarns in a warp knitting machine with three guide bars including a first guide bar, a second guide bar, and a third guide bar to obtain a greige, wherein the three guide bars are fully threaded and have a same yarn lapping movement direction, the first guide bar and the second guide bar use the polyester textured yarn for knitting with a modified warp plain fabric structure, and the third guide bar uses the polyester filament yarn for knitting with a chain-stitch fabric structure;

(3) jet dyeing: performing a direct dyeing treatment on the greige by a jet dyeing machine to obtain a dyed fabric; and (4) post-finishing: carrying out a Stenter setting on the dyed fabric on a Stenter setting machine to obtain a finished fabric with a predetermined width and weight;

wherein the fabric with high shielding performance has a surface compact enough to avoid pinhole light leakage.

2. The method for preparing the fabric with the high shielding performance according to claim 1, wherein in the yarn selection, the first guide bar and the second guide bar use a polyester textured yarn with a denier of 15 D-50 D/6 F-144 F, respectively, and the third guide bar uses a polyester filament yarn with a denier of 15 D-50 D/1 F-144 F.

3. The method for preparing the fabric with the high shielding performance according to claim 1, wherein in the yarn selection, the first guide bar and the second guide bar use a polyester textured yarn with a denier of 20 D-50 D/12 F-144 F, respectively, and the third guide bar uses a polyester filament yarn with a denier of 20 D-50 D/1 F-144 F.

4. The method for preparing the fabric with the high shielding performance according to claim 1, wherein in the warp-knitting, a notation of the first guide bar is 1-0/4-5//, a notation of the second guide bar is 1-0/4-5//, and a notation of the third guide bar is 1-0/0-1//.

5. The method for preparing the fabric with the high shielding performance according to claim 1, wherein in the warp-knitting, a notation of the first guide bar is 1-0/4-5//, a notation of the second guide bar is 1-0/4-5//, and a notation of the third guide bar is 1-0/1-0//.

6. The method for preparing the fabric with the high shielding performance according to claim 1, wherein in the warp-knitting, a notation of the first guide bar is 1-0/4-5//, a notation of the second guide bar is 1-0/3-4//, and a notation of the third guide bar is 1-0/0-1//.

7. The method for preparing the fabric with the high shielding performance according to claim 1, wherein in the warp-knitting, a notation of the first guide bar is 1-0/4-5//, a notation of the second guide bar is 1-0/3-4//, and a notation of the third guide bar is 1-0/1-0//, or the notation of the first guide bar is 1-0/4-5//, the notation of the second guide bar is 1-0/2-3//, and the notation of the third guide bar is 1-0/0-1//, or the notation of the first guide bar is 1-0/4-5//, the notation of the second guide bar is 1-0/2-3//, and the notation of the third guide bar is 1-0/1-0//, or the notation of the first guide bar is 1-0/3-4//, the notation of the second guide bar is 1-0/3-4//, and the notation of the third guide bar is 1-0/0-1//, or the notation of the first guide bar is 1-0/3-4//, the notation of the second guide bar is 1-0/3-4//, and the notation of the third guide bar is 1-0/1-0//, or the notation of the first guide bar is 1-0/3-4//, the notation of the second guide bar is 1-0/2-3//, and the notation of the third guide bar is 1-0/0-1//, or the notation of the first guide bar is 1-0/3-4//, the notation of the second guide bar is 1-0/2-3//, and the notation of the third guide bar is 1-0/1-0//.

8. The method for preparing the fabric with the high shielding performance according to claim 1, wherein the post-finishing further comprises the following steps:

(4a) flame retardant finishing: immersing the finished fabric in a flame retardant solution and drying a resulting fabric after patting the resulting fabric.

9. The method for preparing the fabric with the high shielding performance according to claim 1, wherein each of the polyester textured yarn and the polyester filament yarn has a denier ranging from 20 D to 50 D.

10. A fabric with high shielding performance, wherein the fabric is obtained by the method according to claim 1.

11. The fabric with the high shielding performance according to claim 10, wherein the fabric is used in a preparation of an advertising fabric.

* * * * *